United States Patent [19]

Ludwig et al.

[11] Patent Number: 4,925,258

[45] Date of Patent: May 15, 1990

[54] OFFICE CABINET WITH FLIPPER DOOR AND INTERLOCKING DRAWER AND SUSPENSION ASSEMBLIES

[75] Inventors: Gary L. Ludwig, Kitchner, Canada; Edward M. Verschueren, Chula Vista, Calif.

[73] Assignee: Haworth Sub, Inc., Holland, Mich.

[21] Appl. No.: 205,280

[22] Filed: Jun. 10, 1988

[51] Int. Cl.[5] ..... A47B 88/00

[52] U.S. Cl. ..... 312/323; 312/341.1; 312/331; 312/348.1; 312/348.3; 211/184

[58] Field of Search ..... 312/322, 323, 330 R, 312/341.1, 350, 270, 349, 109, 110, 331, 333, 339, 338, 348.1, 348.3; 16/356; 211/184; 108/61, 102, 143

[56] References Cited

U.S. PATENT DOCUMENTS

| | | | |
|---|---|---|---|
| 972,449 | 10/1910 | Heller | 312/330 |
| 2,268,637 | 1/1942 | Bernstein | 312/330 |
| 2,675,277 | 4/1954 | McClellan | 312/339 |
| 3,033,638 | 5/1962 | Tomlinson | 312/338 |
| 3,368,859 | 2/1968 | Schreyer | 312/330 |
| 3,572,874 | 3/1971 | Hassel | 312/350 |
| 3,677,615 | 7/1972 | Hudson | 312/350 |
| 3,748,005 | 7/1973 | Chovanec et al. | 312/323 |
| 4,112,539 | 9/1978 | Hagen | 312/341 |
| 4,120,551 | 10/1978 | Godtschalck | 312/330 |
| 4,194,793 | 3/1980 | Offermans | 312/341 |
| 4,324,439 | 4/1982 | Hagan et al. | 312/341 |
| 4,423,914 | 1/1984 | Vander Ley | 312/333 |
| 4,473,262 | 9/1984 | Staye | 312/330 R |
| 4,615,570 | 10/1986 | Goodman | 312/110 |
| 4,782,960 | 11/1988 | Mavrakis | 211/184 |

FOREIGN PATENT DOCUMENTS

| | | | |
|---|---|---|---|
| 3005817 | 9/1980 | Fed. Rep. of Germany | 312/330 |
| 7508649 | 10/1976 | France | 312/330 |

*Primary Examiner*—Peter R. Brown
*Assistant Examiner*—Brian K. Green
*Attorney, Agent, or Firm*—Renner, Otto, Boisselle & Sklar

[57] ABSTRACT

A filing cabinet including a flipper door assembly, an interlocking file drawer assembly, and a suspension mounting arrangement for the file drawer. The cabinet comprises a door for closing an opening in a housing, a pair of door guide channels, and a pair of hinge blocks guided by the guide channels. The door is pivotally attached to said hinge blocks for swinging from a closed position covering the opening to a position aligned with the guide channels for insertion into the guide channels and movement into the housing. The guide channels contain the racks of a rack and pinion squaring mechansim which has an equalizing shaft supported by the hinge blocks. The drawer suspension includes telescoping slides and a row of hooks at each side of the drawer engage a row of hook receiving elements on the inner slide rail. The drawer is formed from interlocking components and a divider and hanger bars are installable therein.

25 Claims, 9 Drawing Sheets

OFFICE CABINET WITH FLIPPER DOOR AND INTERLOCKING DRAWER AND SUSPENSION ASSEMBLIES

FIELD OF THE INVENTION

The invention herein disclosed relates generally to office cabinets and, more particularly, to flipper door assemblies and interlocking file drawer assemblies and suspensions for office filing cabinets.

BACKGROUND OF THE INVENTION

Cabinets, particularly filing cabinets, have been provided with doors which are pivoted open from a closed position and then slid into the interior of the cabinet housing. These doors are commonly known in the trade as flipper doors. A wide variety of flipper door assemblies have been proposed and examples of such prior art assemblies are shown in U.S. Pat. Nos. 2,853,355; 3,794,401; 3,909,090; 4,375,907; 4,615,570; and 4,600,254.

Many flipper door assemblies employ a rack and pinion squaring mechanism to prevent jamming or cocking of the flipper door when being slid into and out of the cabinet housing. Some of these assemblies have the pivot or swing axis of the flipper door directly corresponding to the axis of the pinions. In the flipper door mechanism shown in U.S. Pat. No. 3,794,401, for example, the door pivots around a pinion equalizing shaft provided with the pinions at its ends. The pinions are confined within a pair of trackways that contain racks with which the pinions mesh. The shaft also is provided with a pair of rollers which roll along smooth tracks adjacent the racks to support the weight of the door from the meshing teeth of the racks and pinions.

In other flipper door assemblies the pivot axis of the door is located forwardly of the axis of the pinions. One such mechanism shown in U.S. Pat. No. 4,375,907 employs a pair of hinges each having a generally flat part which is mounted to the inside surface of the door and an L-shaped part which has its outermost end rotatably mounted on the pinion equalizing shaft.

Prior art flipper door assemblies have associated therewith one or more disadvantages including: complex and expensive construction, unreliability, inefficient use of cabinet space, noisy and/or difficult operation, etc. Consequently, there remains a continuing need for an improved flipper door assembly for office cabinets and the like which eliminates drawbacks associated with prior assemblies while providing advantages not attainable by known flipper door assemblies.

Flipper doors have been used to cover the openings for pull-out file drawers suspended in filing cabinets. Some drawers for filing cabinet and other office appliances have been assembled from panels secured together by welding and/or by fasteners such as screws, nut and bolts. Other drawer assemblies of interlocking construction have had the panels thereof secured together by tabs mating with openings, and examples of interlocking drawer and other assemblies are shown in U.S. Pat. Nos. 1,621,304; 3,752,553; 4,120,551; and 4,350,257. Drawer assemblies also have employed recesses in side panels to receive a runner track or tabs on runners or slides for interlocking with slots in the drawer side panels, and examples of these drawers and related mounting hardware are shown in U.S. Pat. Nos. 3,771,849; 4,427,245; and 4,458,964. Office cabinet drawers also have been provided with rods for supporting files and examples of these drawers and other containment structures are shown in U.S. Pat. Nos. 1,099,665; 2,278,403; 3,172,711; 3,528,716; and 4,529,092. Notwithstanding the variety of drawer assemblies that are known to the art, there still remains a continuing need for improved drawer assemblies and suspensions having advantages not attainable by known drawer assemblies and suspensions, and especially improved pull-out drawer or other component assemblies for filing cabinets, desks, etc.

SUMMARY OF THE INVENTION

The present invention provides in its preferred application an office filing cabinet including an improved flipper door assembly, an improved interlocking file drawer assembly, and an improved suspension mounting arrangement for the file drawer or other component. Each of these fundamental component assemblies of the invention individually and collectively afford one or more advantages including, inter alia, ease of assembly, relatively few parts and improved performance. Although the invention preferably manifests itself in an office filing cabinet, the below summarized and related novel aspects of the invention may have application in related structures such as desks, shelf assemblies and the like.

According to one aspect of the invention a cabinet comprises a housing, a door for closing an opening in the housing, a pair of door guide channels mounted in the housing at opposite sides of the door, and a pair of hinge blocks guided by the guide channels for movement between extended and retracted positions. The door is pivotally attached to said hinge blocks for swinging from a closed position covering the opening when the guide blocks are in the extended position to a position aligned with the guide channels for insertion into the guide channels and movement with the guide blocks to an open position inside the housing. Preferably, there is provided a squaring mechanism including a pair of racks at opposite sides of the door, a pair of pinions meshed with respective ones of the racks, and an equalizing shaft connecting the pinions for common rotation. The shaft extends between and is supported by the hinge blocks for rotation about an axis fixed with respect to the hinge blocks, and the racks are contained in respective ones of the guide channels. The guide channels also may each include a guide track for the door with the rack recessed with respect to such door guide track. In the preferred embodiment, the swing axis of the door is forwardly offset from the axis of the equalizing shaft.

According to another aspect of the invention a cabinet comprises a housing, a door for closing an opening in the housing, a pair of door guide channels mounted in the housing at opposite sides of the door, a first hinge means guided for horizontal movement between extended and retracted positions within the housing, and second hinge means for pivotally attaching the door to the first hinge means for swinging from a closed position covering the opening when the first hinge means is in such extended position to a position aligned with the guide channels for insertion into the guide channels and movement with the first hinge means to an open position inside the housing. The door has a top edge portion turning rearwardly to define a recess in which the second hinge means is contained, and the first hinge means includes a forward projection extending into the recess for pivotal connection to the second hinge means.

According to a further aspect of the invention a cabinet comprises a housing having side walls, a component such as a drawer disposed within the housing between the side walls, and a suspension for mounting the component within the housing for horizontal movement between retracted and extended positions. The suspension includes a pair of longitudinally telescoping slides one at each side of the component and each including inner and outer telescoping rails, means for attaching the outer rails of the slides to the side walls, and hook means at each side of the component for engaging a respective one of the inner rails for suspending the component. Preferably, the hook means includes a row of hooks, and the inner rail member includes a row of hook receiving elements spaced along its length in which corresponding hooks engage. The hooks and hook receiving elements are correspondingly sized and progressively increase in length going from front to back to provide keying when the component is assembled with respect to the slides by horizontal insertion therebetween. The component preferably has at each side thereof a guide track for receiving and riding on the hook receiving elements during such insertion.

According to yet another aspect of the invention a cabinet comprises a housing having side walls, a component disposed within the housing between the side walls, and means for mounting the component within the housing for horizontal movement between retracted and extended positions. The means for mounting includes a pair of longitudinally telescoping slides one at each side of the component and each includes inner and outer telescoping rails. Clip means on the outer rails are securable in openings in the side walls for mounting the telescoping slides to the side walls, and the component has formed in each side thereof guide track means for guiding insertion of the component between the inner rails when the outer rails are mounted to the side walls. Also provided are means for preventing longitudinal movement of the inner rails relative to the component upon full insertion of the component between the inner rails.

According to a still further aspect of the invention a file drawer comprises a bottom panel having a row of slots adjacent opposite side edges, a pair of side panels each having an inwardly extending bottom shelf for supporting a side edge portion of the bottom panel and a row of tabs projecting inwardly from the shelf for interconnecting with the row of slots, and a back wall extending upwardly from a rear edge of the bottom wall and having locking tabs spaced from the bottom wall, and the side panels having slots proximate rear edges thereof in which the locking tabs are engaged to hold the side panels upright.

According to another aspect of the invention a file drawer comprises bottom, back and side walls, and a divider adjustably positionable between the side walls. The divider has a stabilizing foot at the front thereof with a front edge lip, and the bottom wall includes a groove extending along the front of the bottom panel for capturing the front lip of the foot. Also provided is resilient means cooperating with the back wall for maintaining the front lip engaged in the groove.

The foregoing and other features of the invention are hereinafter fully described and particularly pointed out in the claims. The following description and the annexed drawings set forth in detail a certain illustrative embodiment of the invention which is indicative of but one of the various ways in which the principles of the invention may be employed.

DETAILED DESCRIPTION

Figure 1:
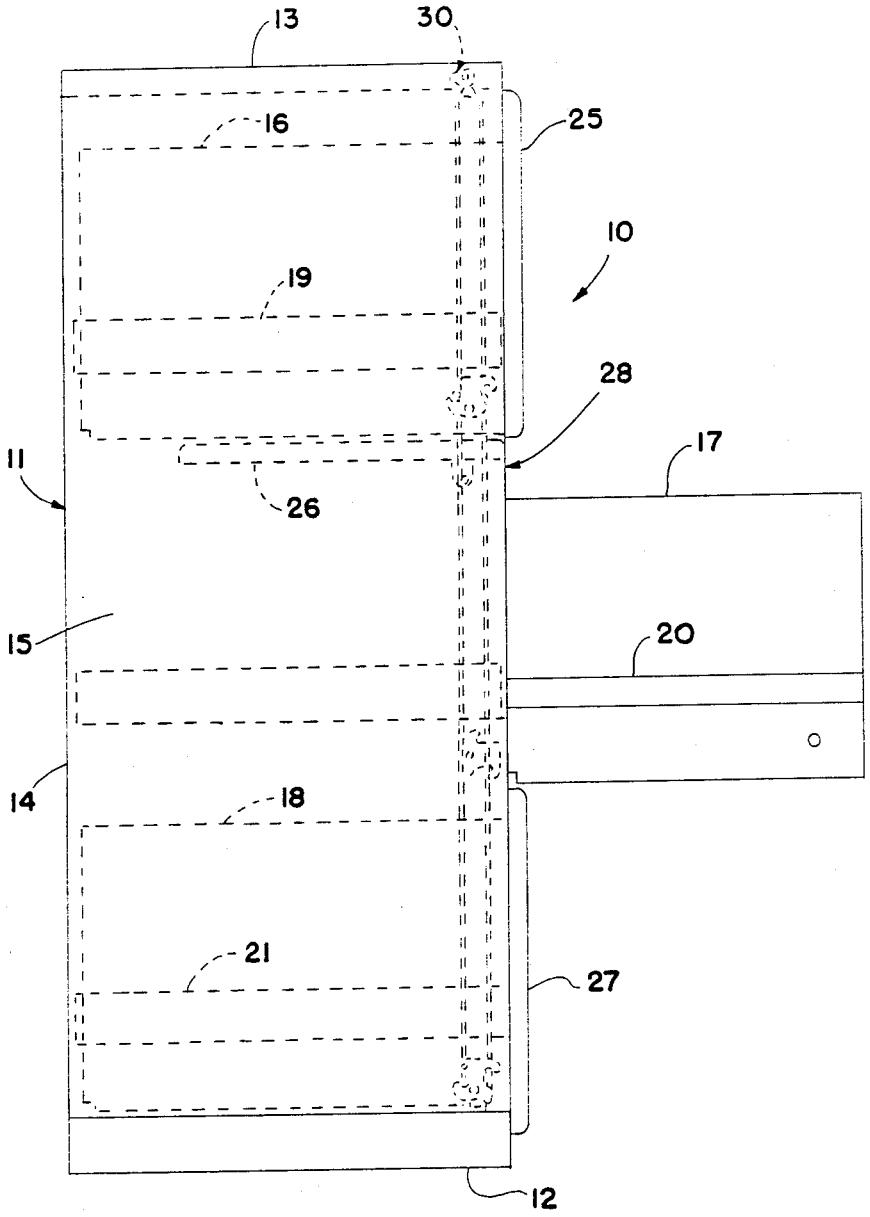
FIG. 1 is a side elevational view of a filing cabinet comprising flipper door and file drawer assemblies according to the present invention.

Referring to the drawings in detail and initially to FIG. 1, a three-high lateral file cabinet is generally indicated at 10. The cabinet 10 includes a housing or enclosure 11 having a base 12, top wall 13, back wall 14 and side walls 15. The base, top wall, back wall, and side walls define an interior space such as a storage compartment for three lateral file drawers 16, 17 and 18. The file drawers 16, 17 and 18 are mounted to the side walls 15 by drawer slides 19, 20 and 21, respectively. In FIG. 1, the upper and lower drawers 16 and 18 are shown fully retracted whereas the middle drawer 17 is shown fully extended.

The file drawers 16, 17 and 18 have associated therewith respective flipper doors 25, 26 and 27. The flipper doors in closed position cover a front opening 28 of the cabinet to conceal the interior compartment and the drawers when stored therein in fully retracted position. In order to open the drawer 17, for example, the flip-up door 26 is pivoted upwardly and then slid rearwardly into the cabinet to its horizontal, full open position illustrated in FIG. 1. The drawer 17 may then be pulled out to its extended position illustrated in FIG. 1.

Although a three-high office filing cabinet is illustrated, it should be understood that file cabinets or other office appliances embodying principles of the invention may be provided with a different number of doors and drawers, and the relative positioning and sizes of the doors and drawers may be varied as desired. The drawers may take various forms including that of a shelf or other component, although a preferred drawer construction is hereinafter described with reference to FIGS. 9–20. The filing cabinet 10 also may be equipped with a lock and interlock mechanism schematically illustrated in broken lines at 30 in FIG. 1. The lock and interlock mechanism 30 is illustrated and described in greater detail in copending application Ser. No. 047,269, filed May 8, 1987, entitled "Office Cabinet".

The flipper doors 25, 26 and 27 in the illustrated cabinet are essentially identical as are their respective operating mechanisms. Accordingly, for conciseness in description, only the flipper door 27 and its associated operating mechanism will be described in greater detail with reference to FIGS. 2–8. Likewise, the file drawers 16, 17 and 18 in the illustrated preferred embodiment are essentially identical and only the file drawer 18 will be described in greater detail with reference to FIGS. 9–20. It should be understood, however, that the following descriptions of the flipper door 27 and file drawer 18 are equally applicable to the other flipper doors and file drawers, respectively.

THE FLIPPER DOOR

Figure 2:
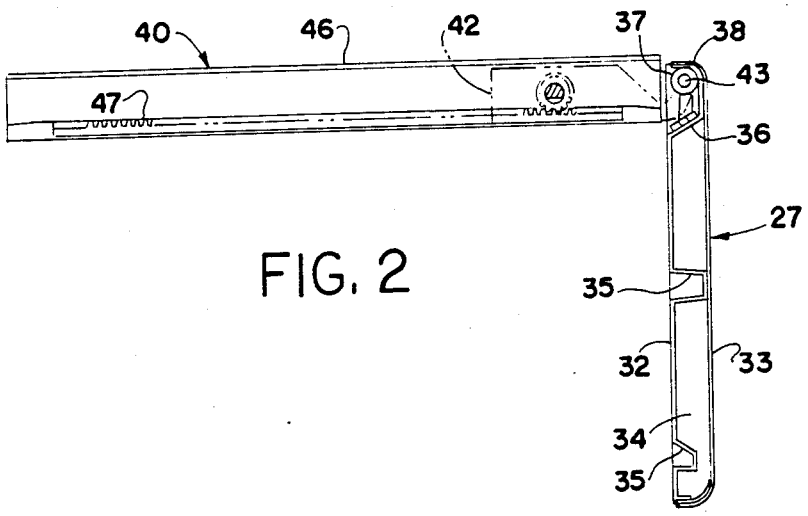
FIG. 2 is a side elevational view of the flipper door assembly with the flipper door shown in fully closed position.
Figure 3:
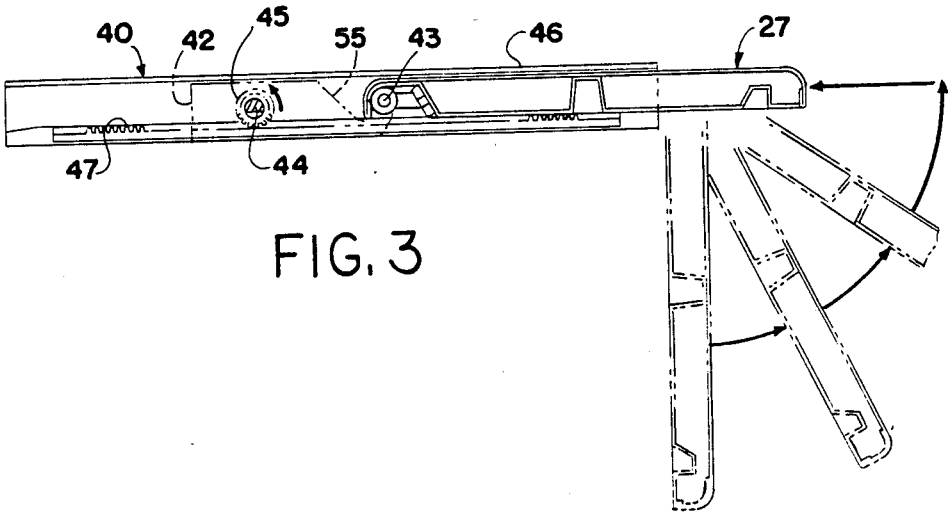
FIG. 3 is a side elevational view of the flipper door assembly with the flipper door shown in a half open position.
Figure 4:
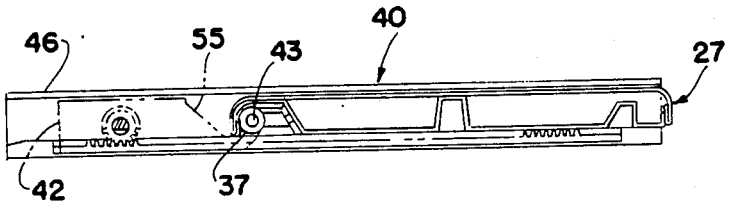
FIG. 4 is a side elevational view of the flipper door assembly with the flipper door shown in fully open position.

As seen in FIGS. 2–4, the flipper door 27 includes inner and outer sheet metal panels 32 and 33 which are bent to desired shape and secured together by suitable means such as sheet metal screw fasteners. The outer panel 33 has a smooth aesthetically pleasing panel face and decorative caps 34 are provided to close the side edges of the door. The inner panel 32 is bent to form reinforcing ribs or channels 35 and an upper channel 36 extending along and adjacent the upper edge of the door. The upper channel 36 forms a recess for containing door hinges 37 mounted to an inwardly facing sloped bottom wall of the channel 36. From the bottom wall of channel 36, juxtaposed upper edge portions of the inner and outer panels extend upwardly and then inwardly to provide a cover flange 38. The cover flange 38 covers and conceals the door hinges 37 which are housed fully within the thickness of the flipper door as shown. The cover flange 38 conceals the door hinges 37 from front and top view when the door is in its closed position shown in FIG. 2.

The door hinges 37, of which there are two, are attached to the flipper door 27 near respective sides of the door. The door hinges are included in a flipper door mechanism indicated generally at 40 in FIGS. 2–4 and further illustrated in FIG. 5. The mechanism 40 functions to mount the flipper door to the cabinet housing 11 and to provide for operation of the flipper door between its full closed, intermediate and full open positions respectively shown in FIGS. 2, 3 and 4.

The flipper door mechanism 40 further comprises a pair of hinge blocks 42 connected by hinge pins 43 to the door hinges 37. The hinge blocks serve as mountings for a pinion equalizer shaft 44 to which pinions 45 are mounted at its ends. The hinge blocks and pinions are positioned for longitudinal movement within inwardly directed door guide channels 46 with the pinions in mesh with racks 47 contained in the door guide channels. The hinge blocks, hinge pins, door hinges, pinions and channels preferably are made of injection molded plastic. As is also preferred, the hinge blocks, hinge pins, door hinges, pinions and channels of each pair thereof are identical and have an element of symmetry for use at either side of the door, thereby to minimize the number of different parts included in the door mechanism 40.

When the flipper door 27 is in its closed position illustrated in FIG. 2, the flipper door pivot or swing axis coinciding with the hinge pins 43 is located forwardly and slightly above the rotation axis of the pinions 45. This forward locating of the pivot axis of the flipper door relative to the rotation axis of the pinions enables the door to close, for example, over the front edges 49 (FIG. 5) of the housing side walls 15. From its closed vertical position, the flipper door can be pivoted forwardly and upwardly (counterclockwise in FIG. 3) to a horizontal position aligned with the door guide channels 46. At this point, the flipper door is slid rearwardly into the cabinet housing 11 with the side edges thereof trapped within and guided by the door guide channels during such horizontal translating movement of the door to its full open position illustrated in FIG. 4. During such horizontal movement of the flipper door, the shaft connected pinions 45 and racks 47 function as a squaring mechanism to keep the door aligned at right angles to the direction of movement to prevent jamming or binding of the flipper door and to give a smooth uniform sliding motion to the door.

The hinge blocks 42 each include a generally block-shape main guide body portion 50 from which a pair of hinge arms 51 extend forwardly. The hinge arms 51 terminate at knuckles 52 which are laterally spaced apart to receive therebetween the knuckle 53 of the corresponding door hinge 37 for connection by hinge pin 43 within the upper channel 36 (FIG. 2). The hinge pin has a split end provided with diametrically opposed protrusions for holding the hinge pin assembled with respect to the hinge parts 37 and 42.

The hinge arms 51 generally have a hook-shape for locating the flipper door pivot axis within the vertical height of the corresponding guide channel 40 while providing a clearance or recess 55. The recess 55, which is defined by the upwardly turned distal end portions 56 of the hinge arms, accommodates the rearwardly turned edge portion of the cover flange 38 when the flipper door is swung open. This enables the flipper door to be swung into horizontal alignment with the door guide channels 46 for rearward longitudinal insertion between the door guide channels 46 and movement with the hinge blocks. When the flipper door is slid rearwardly into the cabinet, side edge portions thereof are guided within the guide channels 46.

Figure 6:
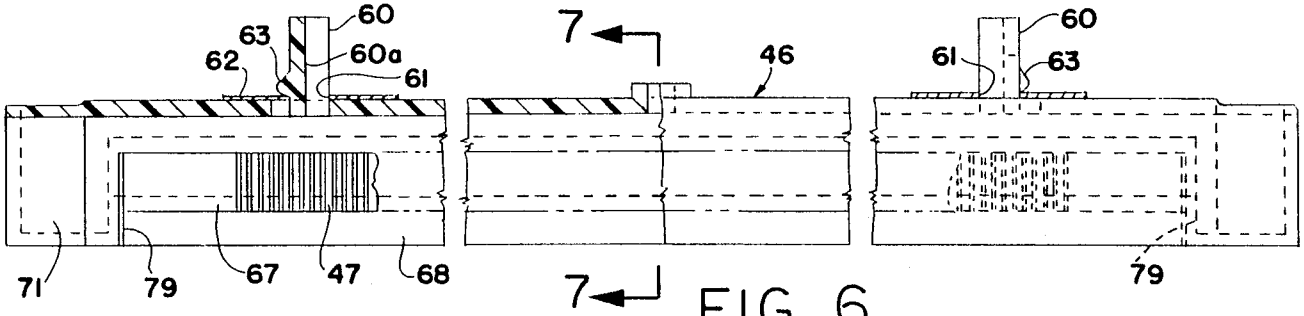
FIG. 6 is an enlarged top plan view, partly broken away, of a door guide channel used in the flipper door assembly.
Figure 8:
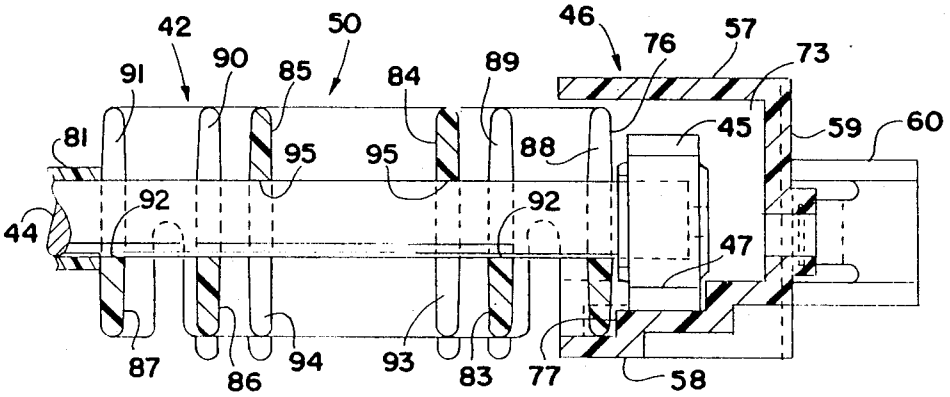
FIG. 8 is a sectional view similar to FIG. 7 but showing components of the flipper door assembly assembled with respect to the door guide channel.
Figure 7:
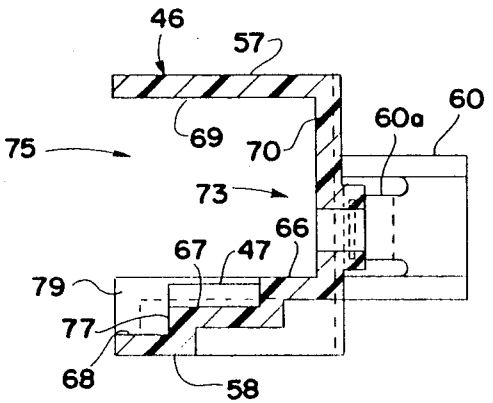
FIG. 7 is an enlarged sectional view through the door guide channel taken along the line 7—7 of FIG. 6.

As best seen in FIGS. 6–8, each door guide channel 46 is generally C-shape in cross-section and has top and bottom walls or flanges 57 and 58 which extend inwardly from the top and bottom edges of a vertical wall or web 59. Flanges 57 and 58 are the upper and lower track surfaces, respectively, and together for guide tracks for door 27 and hinge block 42. Extending outwardly from the web 59 are two tab-like mounting devices 60 at locations spaced apart along the length of the guide channel. The mounting devices or tabs 60 snap into respective holes 61 provided in the inner sheet metal panel 62 of the corresponding housing side wall 15 for mounting the guide channel to the side wall 15. The tabs 60 include latching arms **60*a* which are deflectable in cantilever-like manner to allow latching elements 63 on the arms 60*a* to pass through the openings 61 and then snap back behind the inner sheet metal panel 62 to lock the guide channel in place. As shown in FIG. 6, the latches 63 may be provided with ramp-like leading surfaces which, during insertion of the tabs into the holes, cooperate with the edges of the holes to cammingly urge the tabs towards one another and sufficiently to allow passage of the latches through the holes 61**.

Each door guide channel 46 preferably is symmetrical about its transversely extending median plane whereby the guide channel is unhanded for use at either side of the cabinet. Consequently, both ends of the guide channel are open to permit insertion therein of flipper door edge portions.

Figure 5:
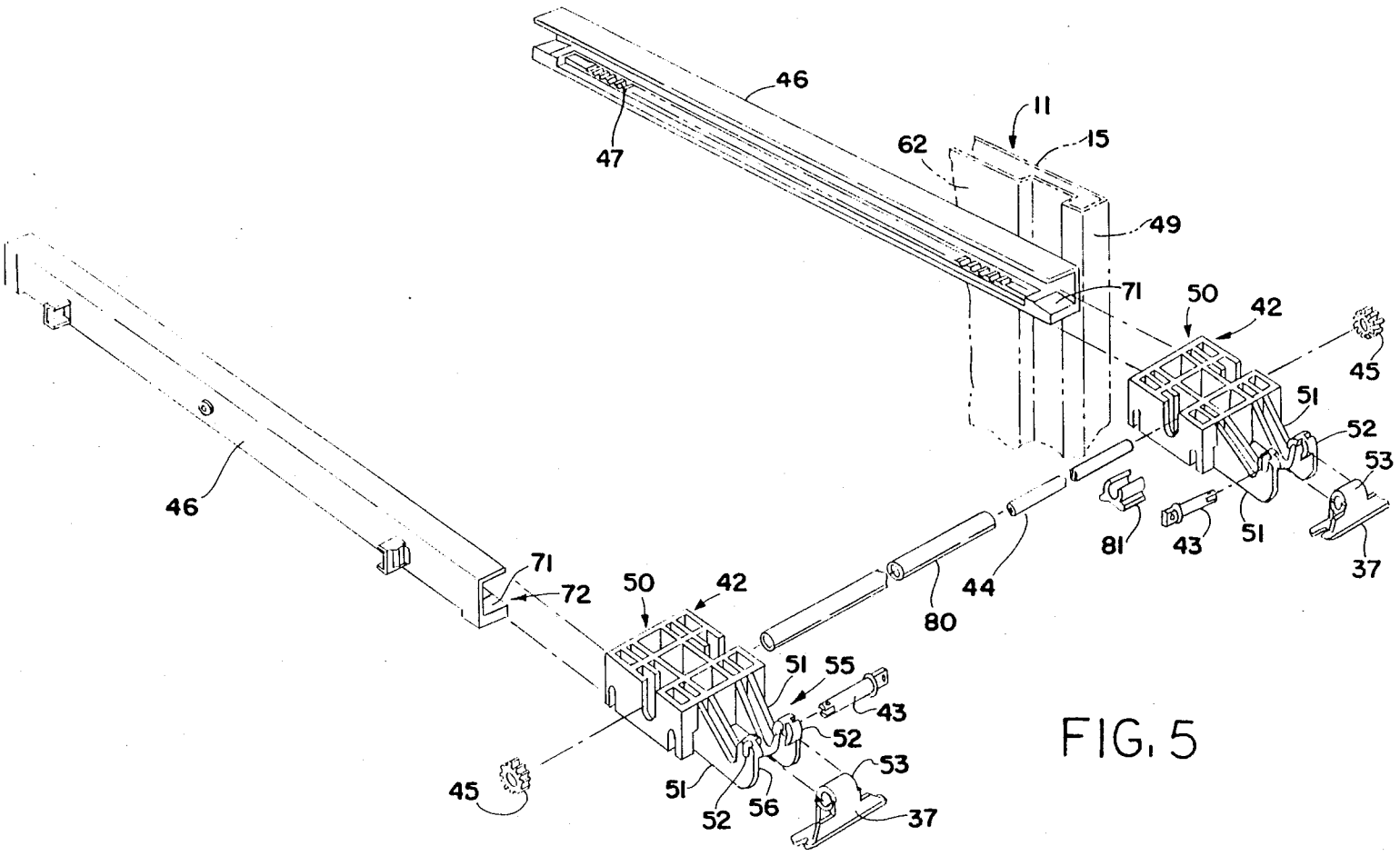
FIG. 5 is an exploded perspective view of the flipper door assembly sans flipper door.

The bottom flange 58 of each door guide channel 46 is stepped to provide, going from right to left in FIG. 7, an outer surface 66, an intermediate surface 67 and an inner surface 68 at progressively lower elevations. The outer surface 66 extends horizontally and parallel to the bottom surface 69 of the upper channel flange 57, and the surfaces 66 and 69 extend horizontally substantially the entire length of the guide channel to form a guideway or track in which the adjacent edge portion of the flipper door is received and guided when the door is opened and slid into the cabinet housing. The door track surfaces 66 and 69 cooperate to guide the flipper door as it is slid horizontally in and out of the cabinet. The vertical inner surface 70 of channel web 59 could also be used as a lateral guide for the flipper door so as to prevent cocking of the door about a vertical axis, but preferably this function is served by the rack and pinion squaring (equalizing) mechanism hereinafter described. At both ends of the guide channel the bottom door track surface 66 terminates flush with the upper end of a downwardly sloping lead-in surface 71 which is best shown in FIG. 5. The sloping lead-in surface 71 cooperates with the upper channel flange 57 to form a tapered entranceway 72 for facilitating insertion of the flipper door into the guide channel after it has been swung to a horizontal position generally aligned with the guide channel or, more particularly, the flipper door track indicated generally at 73 in FIG. 7.

The inner surface 68 of the bottom flange 58 extends horizontally and parallel to the bottom surface 69 of the upper flange 57 and together form a guideway or track 75 for guiding the hinge blocks 42. As shown in FIG. 8, each hinge block 42 has an outer wall 76 which has a horizontal bottom surface that slides on the bottom track surface 68 and which is vertically retained between the surfaces 68 and 69 for guided horizontal movement of the hinge block. The hinge block also is restrained against lateral outward movement by engagement of the wall 76 against the stepped shoulder surface 77 extending upwardly from the surface 68 along the full length thereof.

At its ends, the bottom track surface 68 terminates at opposed stop surfaces 79 which limit forward and rearward movement of the hinge block and thereby define full extended and full retracted positions of the hinge block. The stops prevent the hinge block from being withdrawn forwardly or rearwardly from the guide channels 46 and further serve properly to locate the hinge blocks at positions corresponding to full open and full closed positions of the flipper door.

Perhaps it should be noted here that the transverse spacing of the hinge blocks 42 is maintained by their mounting to the flipper door hinges 37. In addition, the proper separation and spacing of the hinge blocks 42 is maintained by spacer sleeve 80, and a removable spacer snap clip 81. This ensures the spacing of the hinge blocks and also that the pinions remain in proper engagement with the racks. The hinge blocks also are maintained generally coplanar by the door hinges in cooperation with the equalizing shaft 44 and spacers. It also should be understood that in the illustrated preferred embodiment, the hinge blocks are symmetrical about a longitudinally extending vertical center plane as can be seen in FIGS. 5 and 8. Accordingly, the hinge blocks are unhanded for use at either side of the cabinet 11. Although less desirable, the hinge blocks may be joined to form a unitary structure.

As seen in FIGS. 5 and 8 each hinge block main guide body portion 50 is formed of a reticulate framework of vertical walls. There are four spaced walls parallel to the axis of the shaft 44 including the front wall from which the arms 51 extend. There are six spaced walls normal to the axis of the shaft which include the outer wall 76, and walls 83, 84, 85, 86 and 87. The wall 87 of course becomes the outside wall of the opposite hinge block. The walls 76, 83, 86 and 87 are provided with U-shape notches 88, 89, 90 and 91 which at the bottom each include circular bight portions 92 acting as bearing saddles for shaft 44. The inner walls 84 and 85 include notches 93 and 94 extending from the bottom of such wall each of which has a circular bight portion 95 acting as bearing surfaces against the top of the shaft 44. The close spacing of the walls 85, 86 and 83, 84 provides the equivalent of a completely enclosed bearing surface while the U-shape saddle bearing surfaces of the outside walls provide good stability. Also with the construction shown the hinge block can readily be injection molded.

At each end, the shaft 44 extends beyond the outer wall 76 of the respective hinge block 42 and has the respective pinion 45 mounted thereon. The pinion is keyed to the shaft by suitable means for common rotation such as by providing corresponding flats on the shaft and in the center bore of the pinion. The pinion also preferably is fixed to the end of the shaft by suitable means such as by being press fitted on the end of the shaft.

As seen in FIG. 8, the pinion 45 meshes with the rack 47 provided on rack surface 67. The rack preferably is integrally formed with the guide channel such as during injection molding thereof. The rack extends horizontally a length which ensures that the pinion will be in mesh therewith over the full extent of longitudinal movement of the hinge blocks 42 and door 27. As seen in FIGS. 7 and 8, the rack 47 is vertically recessed in relation to the door guide track 73 (i.e., is downwardly offset with respect to the bottom door track surface 66) for spaced passage of the door thereover.

Preferably, the weight of the flipper door 27 is supported by the hinge blocks 42 independently of the pinions 45 while the pinions 45 are free to rotate relative to the hinge blocks. This arrangement overcomes the problem of chatter that has plagued prior flipper door mechanisms using a rack and pinion equalizing mechanism. The arrangement also provides for efficient operation of the equalizing mechanism and easy opening and closing of the flipper door. In operation, the meshed gearing at each end of the shaft ensures that each side of the flipper door will travel the same distance thereby to obtain uniform movement of the flipper door and prevention of twisting or jamming of the flipper door.

THE FILE DRAWER

Figures 9, 21:
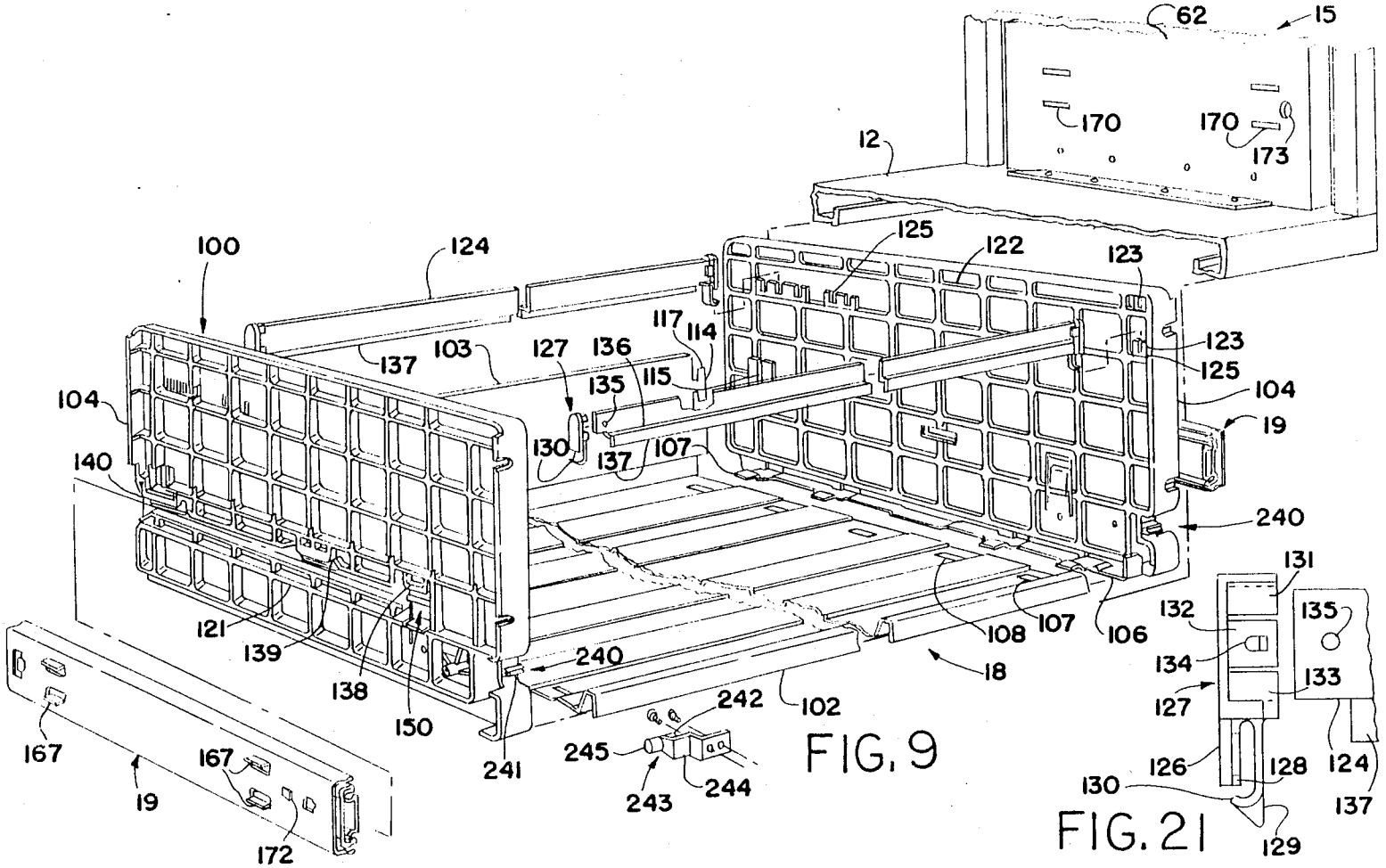
FIG. 9 is an exploded schematic fragmentary perspective view of the file drawer assembly including a file cradle.
FIG. 21 is an enlarged fragmentary vertical section of the hang file bar and clip seen in FIG. 9.

Details of the file drawer or drawer assembly 18 can be seen in FIG. 9 which is a quasi-perspective view, i.e., the view is not a true perspective view inasmuch as the relative dimensions going from left to right vary nonuniformly for purposes of illustration. As shown, the drawer assembly 18 generally comprises a drawer or cradle 100 supported and guided by drawer slides attached to the side walls of the cabinet. As will be seen, the various components of the cradle and the overall drawer assembly are of interlocking type which permits their assembly without tools as is preferred.

The cradle 100 comprises a bottom panel 102, a back panel 103 and side panels 104. The bottom panel and back panel preferably are formed from sheet metal bent to form a lower rear corner integrally joining the back panel to the bottom panel.

In the illustrated preferred embodiment, the side panels 104 are made of injection molded plastic and are mirror images of one another. Each side panel has along its lower edge an inwardly extending flange or shelf 106 from which tabs 107 project. The tabs interlock in corresponding slots 108 arranged in a row along the adjacent side edge of the bottom panel 102.

Figure 10:
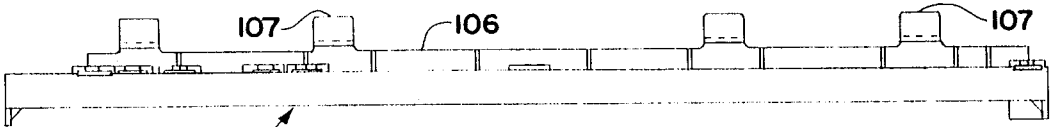
FIG. 10 is a top plan view of a side panel of the file cradle.
Figure 11:
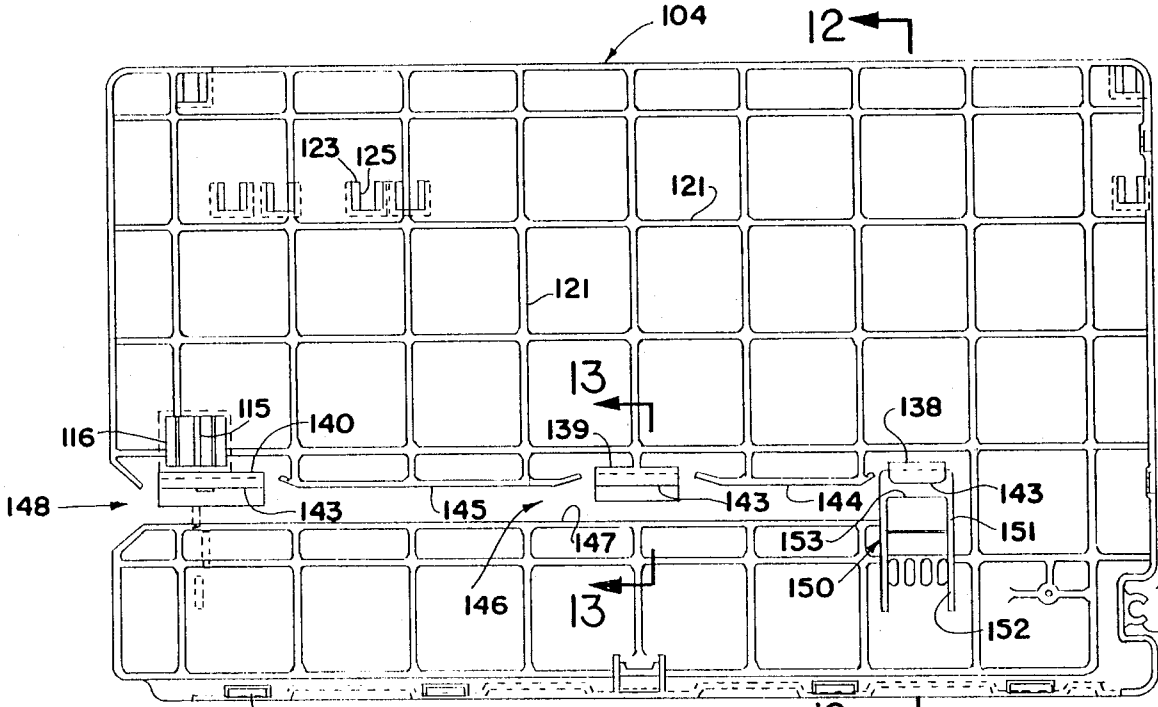
FIG. 11 is an outside elevational view of the cradle side panel.
Figures 12, 13, 14, 15, 16, 17:
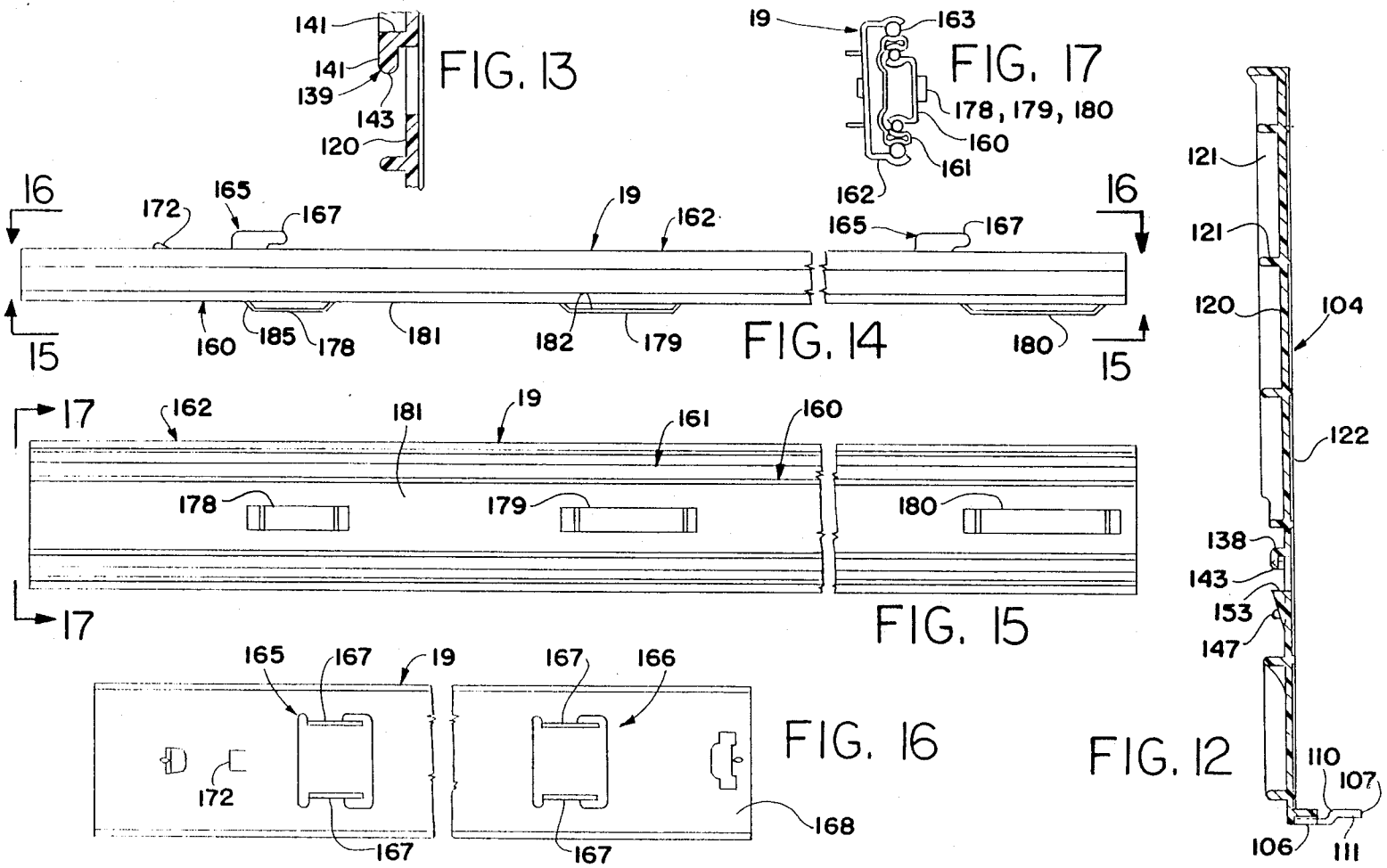
FIG. 12 is a vertical sectional view through the cradle side panel taken along the line 12—12 of FIG. 11.
FIG. 13 is a partial sectional view through the cradle side panel taken along the line 13—13 of FIG. 11.
FIG. 14 is a top plan view of a slide used to suspend the file cradle in the cabinet.
FIG. 15 is a fragmentary inside elevational view of the slide taken along the line 15—15 of FIG. 14.
FIG. 16 is a fragmentary outside elevational view of the slide taken along the line 16—16 of FIG. 14.
FIG. 17 is an end elevational view of the slide taken along the line 17—17 of FIG. 15.

The configuration of the tabs 107 is shown in FIGS. 10–12. The tabs initially extend from shelf 106 inwardly and then upwardly at an offset 110 for passage through the slots in the bottom panel. The tabs terminate at another horizontal portion 111 which will overlie the bottom panel and operate to hold the outer edge portion of the bottom panel atop the side panel's bottom shelf 106. In this manner the side panel can be securely interlocked along its lower edge to the bottom panel.

Assembly of each side panel 104 to the bottom panel 102 is obtained by first orienting the side panel at an oblique angle to the bottom panel to permit insertion of the tabs 107 into the slots 108. The tabs may then be moved inwardly to locate the offset 110 at the slots at which point the side panel can then be tilted upright to a position generally perpendicular to the plane of the bottom panel. As the side panel is being tilted upwardly to position, a T-shape tab 114 at the adjacent side edge of the back wall 103 is inserted into a slot 115 in the side panel. The slot 115 is located in the base of an inwardly protruding pocket 116. The tab has a reduced neck portion and a head having top and bottom ears 117 which originally are disposed in the plane of the back wall. After the tab has been inserted into the slot to locate the ears 117 inwardly of the bottom wall of the pocket (and preferably fully contained in the pocket), the head of the tab is then deformed as by bending the ears laterally with respect to the slot 115 to prevent their return passage back through the slot and therby to engage the tab in the slot.

In this manner the tab and slot arrangement function as a fastening device for maintaining the side panel 104 upright and generally perpendicular with respect to the bottom and back panels 102 and 103. Although other fastening means such as screws may be used to secure each side panel to the back panel generally in the region of the tab 114 and slot 115, the illustrated tab and slot arrangement is preferred in that it eliminates the requirement for tools and especially the requirement for a screwdriver. If desired, the ears 117 may be bent or the tab otherwise deformed by using a tool such as pliers, but the task of deforming the tab normally would be simpler and less time consuming than having to install and tighten a screw fastener or fasteners.

As shown in FIGS. 11 and 12, each side panel 104 has a main vertical wall 120 which is reinforced by a plurality of vertical and horizontal ribs 121 arranged in a grid-like or honeycomb-like pattern on the outer side of the panel wall. The ribs 121 extend from the wall 120 a distance greater than the thickness of the wall and preferably several times the wall thickness for adequate reinforcement and strength. The side panel also has a similar arrangement of ribs 122 on its inner side. The side panel also is provided with a plurality of hanger bar mounts 123 for supporting the ends of file hang bars 124 extending between the side panels.

As shown in FIGS. 9 and 21, the mounts 123 are in the form of a pocket with the front of the pocket including an upwardly opening slot 125. The pocket and slot is sized to receive a vertically extending tongue 126 which is generally T-shape in horizontal section on hang bar clip 127. The stem 128 of the T fits within the slot and holds the clip against lateral movement. The front of the clip includes a cam finger 129 provided with a lip 130 which snaps over the bottom of the mount to keep the clip in place. The upper portion of the clip includes a pocket formed by three projections 131, 132 and 133 with the middle or center projection being offset from the upper and lower projections. The center projection includes a lateral button projection 134 which snaps into hole 135 in the ends of the file hang bar 124. Such ends fit closely between the upper and lower projections, and offset middle projection. The hang bar between its ends includes an offset lower horizontal flange 136 which terminates in a downwardly bent edge 137. The rebent flange serves to stiffen the hang bar and also make it more easily handled.

In well known manner, the hang bars 124 may be used to hang therefrom suspended files. The mounts 123 for the hang bars are strategically placed on the inner sides of the cradle side panels 104 to permit adjustment for different heights and widths of files.

At the outer side of each side panel 104 there is provided a hanger construction preferably formed as an integral part of the side panel. In the illustrated embodiment, the hanger construction comprises three horizontally spaced apart hooks 138–140 which project outwardly from the panel wall 120 as representatively shown in FIG. 13 with respect to the middle hook 139. Each hook has a downwardly extending lip 141 spaced from the panel wall 120 by a horizontal leg portion 142.

As seen in FIG. 11, the hooks 138–140, or more particularly their lips 141, are of progressively increasing length going from front to rear (right to left in FIG. 11). The bottom lip edges 143 of the hooks are aligned with one another and with runner surfaces 144 and 145. The runner surface 144 extends between the forward and intermediate hooks 138 and 139 while the runner surface 145 extends between the intermediate and rearward hooks 139 and 140. The runner surfaces 144 and 145 may be provided at their leading and trailing ends with upwardly flared surfaces and together the runner surfaces and lower edges 143 of the hook lips 140 define the upper side of a guide channel or track indicated generally at 146. The bottom side of the guide channel 146 is defined by runner surface 147 which is parallel to and vertically spaced beneath the upper runner surfaces 144 and 145. The guide channel has at the rear end of the side panel 104 a tapered entranceway 148.

The forward hanger hook 138 has associated therewith a latching device 150. The latching device 150 includes a resiliently deformable latch arm 151 extending upwardly in cantilever like manner in an opening 152 in the panel wall 120. The latching arm 151 terminates at a top latching surface 153 which, as seen in FIG. 12, extends outwardly to approximately the same extent of the hook 138 in opposition to the bottom lip surface 143 of the forward hanger hook 138 when the latching arm is in its unflexed condition shown in FIG. 12. For a purpose discussed hereinafter, the latching arm may be flexed inwardly to move the latching surface 153 out of opposing relationship to the bottom surface 143 of the hook 138.

Referring to FIG. 9, the hanger construction provided on each side panel 104 provides for mounting of the cradle 100 to the drawer slide devices 19 which, in the illustrated embodiment, are of three section, ball bearing type. The slide devices 19 preferably are identical and symmetrical about a horizontal centerline for use at either side of the cabinet housing 11.

As seen in FIGS. 14–17, each slide device 19 includes three telescoping rails, i.e., an inner rail 160, an intermediate or floating rail 161 and an outer rail 162. The rails are all generally C-shape in cross section with the inner rail 160 facing opposite the other two rails 161 and 162. In conventional manner, each rail has webs interconnecting upper and lower flanges which cooperate to form runways for ball bearings 163. The ball bearings 163 function to maintain the rails in telescoping relationship while permitting smooth efficient movement of each rail relative to the other rails. Although not shown, suitable stops may be provided for limiting the extent of movement of the inner rail relative to the intermediate rail and the intermediate rail relative to the outer rail.

The outer rail 162 is provided with front and rear clip mounts 165 and 166. In the illustrated embodiment, the clip mounts are identical and each includes a pair of vertically spaced hooks 167 projecting outwardly from web 168 of outer rail 162. The hooks both open rearwardly (to the right in FIGS. 14–16) and preferably the hooks are formed as an integral part of the outer rail as by stamping from the web 168.

Each slide device 19 is mounted to the respective side wall 15 by inserting the hooks 167 into respective slots 170 provided in the inner panel 62 of the side wall as shown in FIG. 9. The hooks are inserted into the slots until the web 168 of the outer rail engages the inner side wall panel 62 and then the outer rail is shifted rearwardly to engage the hooks with respect to the side wall. Preferably, the hooks define with the web a bight of the hook having a thickness closely equal the thickness of the inner side wall panel 62 thereby to prevent any movement of the outer rail relative to the side wall in a direction perpendicular to the side wall. As for return forward movement of the outer rail that could disengage the outer rail from the side wall, this is prevented by a protrusion and detent mechanism.

In the illustrated embodiment, the protrusion and detent mechanism includes a protruding catch 172 on the web 168 of the outer rail and a cooperating detent opening 173 in the inner panel 62 of the side wall 15. The catch 172 preferably is formed as an integral part of the web and is resiliently deformable into the plane of the web to permit full insertion of the hooks 167 into the slots 170. After rearward shifting of the outer rail, the catch will move to alignment with the detent opening whereupon the catch will move outwardly towards its unflexed position to engage in the hole thereby to prevent return forward movement of the outer slide rail 162.

After thusly mounting of the slide devices 19 to the side walls 15 of the cabinet housing 11, the cradle 100 may then be mounted to, or more particularly suspended from, the inner rails 160 of the slide devices. For this purpose and as shown in FIGS. 14, 15 and 17, the inner rail 160 of each slide device is provided with hanger bar loops 178–180 to be engaged by respective ones of the hanger hooks 138–140 provided on the cradle side panels 104. The loops are spaced along the horizontal center axis of the inner rail in correspondence with the spacing of the hanger hooks. The loops preferably are formed as an integral part of the inner rail web 181 from which they project and form socket-like openings 182 for receiving the lip portions 141 (FIG. 13) of the hanger hooks 138–140. Moreover, the hanger hooks are keyed with respect to their corresponding loops as by providing the illustrated three different sizes of loops and hooks. That is, the forward socket 178 is too small to prevent entry therein of either the intermediate or rearward hooks 139 and 140 and the intermediate loop 179 is too small to permit engagement therein of the rearward hook 140.

Accordingly, after the drawer slide devices 19 have been mounted to the side walls 15 of the cabinet housing 11, the cradle 100 may be inserted into the cabinet with the guide track 146 at each side thereof aligned with the row of hanger bar loops 178–180 of the adjacent slide device. The upper and lower surfaces of the guide track are spaced to engage the top and bottom surfaces of the hanger bar loops for guided insertion of the cradle into the cabinet between the slide devices. During initial insertion of the cradle into the cabinet, the tapered entranceway 148 facilitates alignment of the guide track with the row of hanger bar loops and after an initial amount of insertion the hooks and upper track surfaces may ride along the top surfaces of the bar loops thereby to carry at least a portion of the weight of the cradle during insertion of the cradle into the cabinet housing.

Because of the above described keyed relationship between the hanger hooks 138–140 and hanger bar loops 178–180, the lip portion of the rearward hanger hook 140 will ride over the forward and intermediate loops 178 and 179 until it aligns with the rearward loop 180. Once aligned, the lip portion of the rearward hanger hook 140 will drop into and engage in the rearward hanger loop 180. Similarly, the intermediate hanger hook 139 will ride over the forward hanger loop 178 and thereafter engage with the intermediate hanger loop 179 when vertically aligned therewith. At the same time that the rearward and intermediate hanger hooks engage their respective hanger loops, the forward hanger hook will be aligned with its hanger loop for engagement therewith.

Just before the side panels 104 of the cradle 100 assume their final position relative to the inner rails 160 of the slide devices 19, the upper end of the latching arm 151 on each side panel will be at a height above the height of the bottom edges of the loops 178–180. During insertion the bottom edges of the loops ride on the bottom track surface 147 and it can be seen in FIG. 11 that the latching arm 151 projects upwardly beyond this bottom surface 147. As the cradle side panel approaches its final position with respect to the inner rail of the slide device, the sloping leading surface 185 (FIG. 14) of the forward loop 178 will cammingly flex the latching arm 151 into the plane of the side panel wall 120 to permit the forward hanger hook 138 to pass over and into alignment with the forward loop 178. Once aligned, as above described, the forward hanger hook will drop down to engage in the forward loop. As this occurs, the upper end of the latching arm will move downwardly to a position just beneath the bottom edge of the forward loop 178 whereupon the latching arm will flex back towards its original position. The upper end of the latching arm will then be positioned to engage th bottom edge of the forward loop to prevent the forward hanger hook from being lifted out of engagement with the forward loop. If later it is desired to remove the cradle from the cabinet, the latching arm may be flexed inwardly to clear the forward hanger loop to permit disengagement (lifting) of the forward hanger hook from the forward hanger loop while at the same time disengaging the other hooks from their respective loops to permit forward movement of the side panel relative to the inner slide rail.

Figure 18:
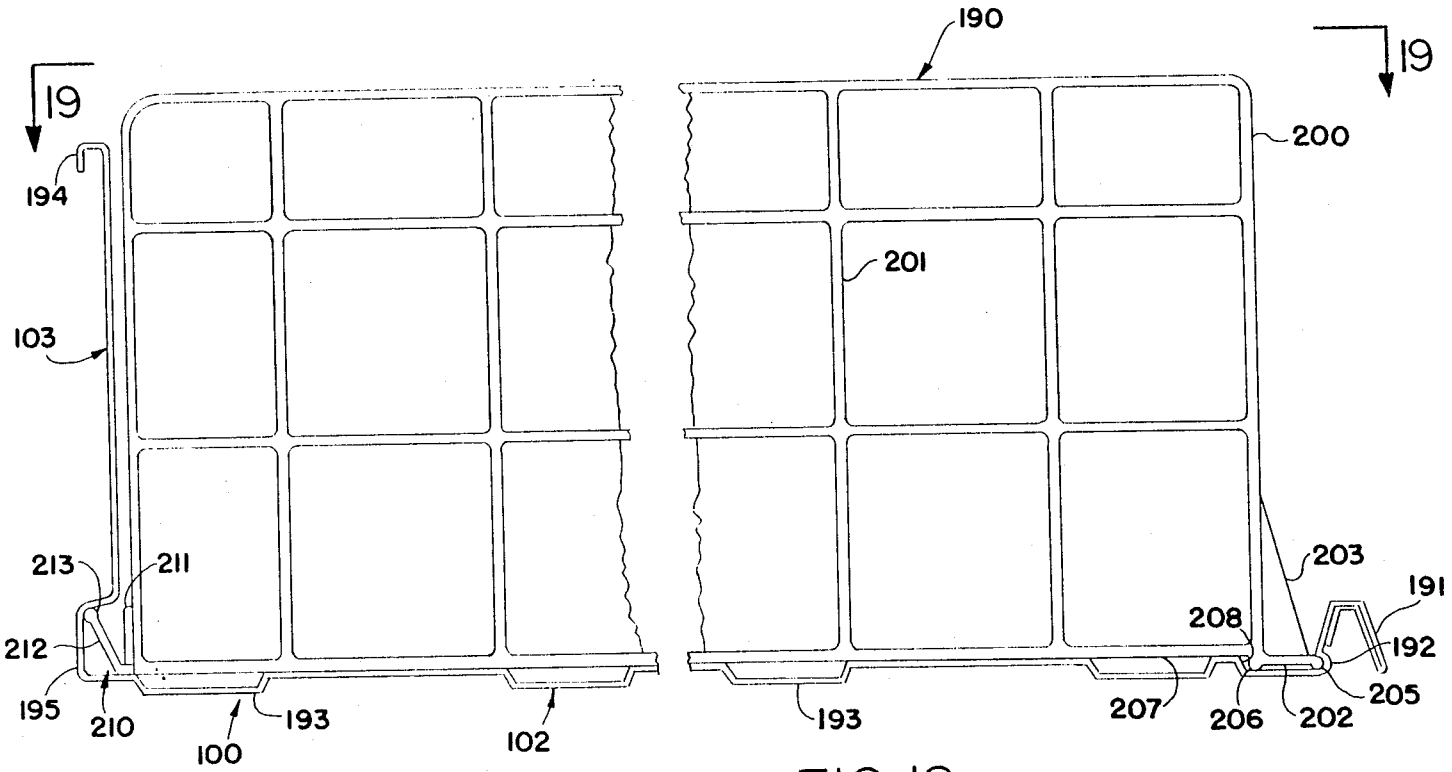
FIG. 18 is a fragmentary side elevational view of a divider for the cradle shown assembled with respect to bottom and back panels of the cradle.
Figure 19:
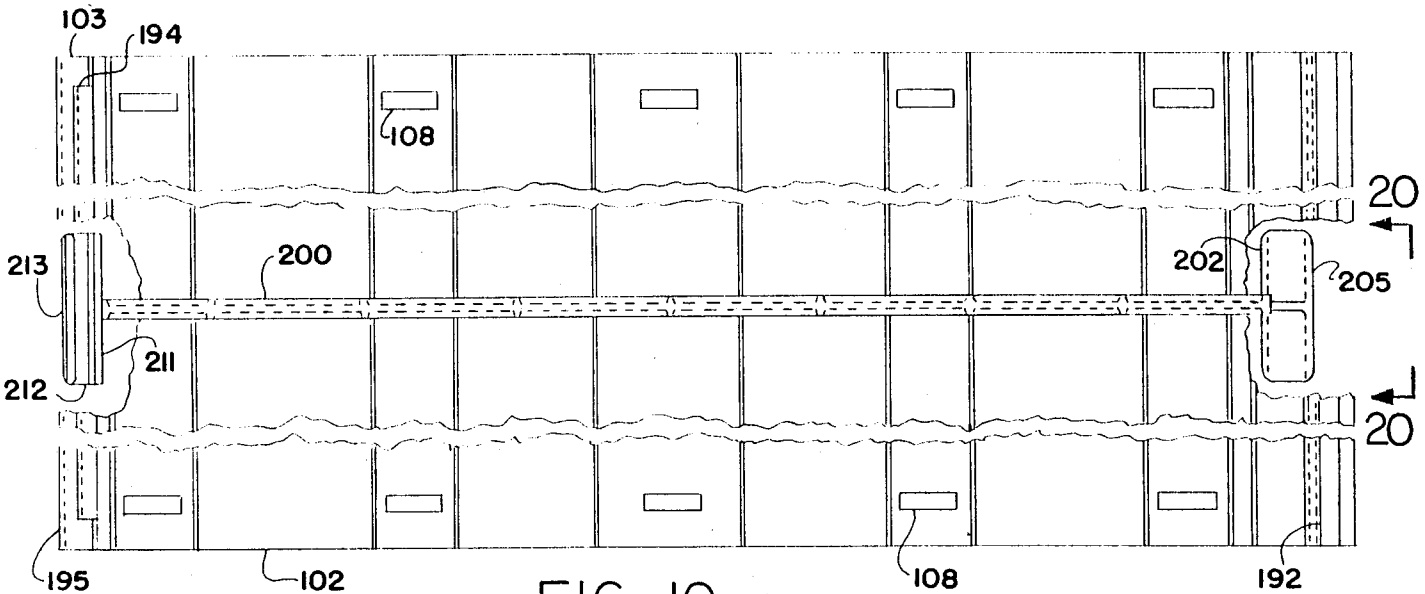
FIG. 19 is a fragmentary top plan view, partly broken away, of the cradle and divider assembly taken along the line 19—19 of FIG. 18.
Figure 20:
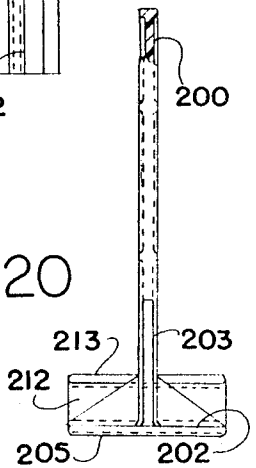
FIG. 20 is a reduced end elevational view of the cradle divider taken along the line 20—20 of FIG. 19.

Referring now to FIGS. 18–20, the cradle 100 may be outfitted with a divider generally indicated at 190. The divider 190 is shown installed with respect to the bottom panel 102 and back panel 103. The bottom panel 102 has a double thickness forward edge portion 191 configured as shown. Rearwardly of the forward portion 191 there is provided a rearwardly opening channel 192 extending the width of the bottom panel. The bottom panel over the major planar portion thereof is provided with channel-like depressions 193 which may have the side panel mounting slots 108 located in the bottom walls of these depressions as shown in FIG. 19. At the rear end of the bottom panel the back panel 103 is bent upwardly and may be reversely turned back along its upper edge as seen at 194. At the bottom of the rear panel at its point of intersection with the bottom panel, there is provided a forwardly opening retention channel 195 disposed generally rearwardly with respect to the major planar extent of the back wall.

The divider 190 includes a divider panel 200 which, in the illustrated embodiment, has reinforcing/decorative ribs 201 provided on both sides in a like pattern preferably corresponding to the rib pattern of the cradle side panels. The divider panel 200 may be of the illustrated rectangular shape or other shape as desired. At its lower front edge the panel is provided with a forwardly projecting, laterally extending foot 202. The foot 202 is reinforced by a triangular gusset 203 coplanar with the divider panel. The foot extends laterally outwardly from the plane of the divider panel by an amount sufficient to provide adequate support for maintaining the panel upright during normal use conditions when installed in the cradle as herein described.

The foot 202 has a rounded front lip 205 extending along its leading edge for engaging in the correspondingly rounded channel 192 in the bottom panel. The foot also has extending along its rear edge a heel 206 which projects beneath the bottom surface 207 of the divider panel. As seen in FIG. 18, the bottom panel is bent to form a retention surface 208 operative to engage the rear surface of the heel 206 to prevent withdrawal of the toe lip 205 of the foot from the retention channel 192. In this manner, the forward end of the divider panel is firmly held in place and upright with respect to the bottom panel.

In order to install the divider 190 with respect to the bottom and back panels, the divider is disposed at an angle to the bottom panel to permit insertion of the toe lip 205 into the retention channel 192 therefor. The divider may then be rotated counterclockwise in FIG. 18 to lower the divider panel onto the bottom panel 102 and further to bring the heel 206 of the foot into confronting relationship with the retention surface 208 which prevents disengagement of the lip from the channel unless the heel is pivoted clear of the retention surface 208. To prevent such pivoting, the divider preferably is provided at the lower rear edge of the panel 200 with a resilient holding device indicated at 210 in FIGS. 18 and 19. The resilient holding device 210 generally comprises a transversely extending base 211 and a resilient latching flange 212 which normally slopes upwardly from the lower edge of the base 211. The latching flange 212 terminates at a rounded bead 213 operative to engage in the upper rear corner of the channel 195. During the above described downward rotation of the divider during installation, the latching flange 212 is free to flex forwardly to clear the back wall 103. After the divider has been rotated to rest atop the bottom panel 102, the latching flange 212 returns towards its normally unflexed condition to engage in the channel 195 thereby to prevent reverse rotation of the divider panel, i.e., clockwise rotation as seen in FIG. 18. The flexible latching flange preferably is of a lateral length sufficient to provide adequate stabilization for the rear end of the divider panel.

Referring back to FIG. 9 it will be seen that the front edge of each side panel 104 is provided with a narrowed recess shown generally at 240 in which is integrally formed a C-shape spring clasp 241. The clasp 241 is designed releasably to engage the inside portion 242 of pin 243 supported by bracket 244 on the interior lower edge of each side of the flip up door 27. The outside portion 245 of the pin extending to the left in FIG. 9 is positioned to engage the lock and interlock mechanism shown in the aforenoted copending application Ser. No. 047,269, filed May 8, 1987. The pin-clasp engagement keeps the door from hanging loose quite apart from the lock-interlock mechanism.

Although the invention has been shown and described with respect to a certain preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A cabinet comprising a housing, a door for closing an opening in said housing, a pair of door guide channels mounted in said housing at opposite sides of said door, and a pair of hinge blocks guided by said guide channels for movement between extended and retracted positions, said door being pivotally attached to said hinge blocks for swinging from a closed position covering said opening when said guide blocks are in said extended position to a position aligned with said guide channels for insertion into said guide channels and movement with said guide blocks to an open position inside said housing, wherein a bottom surface of each hinge block rests, at least partially, on the corresponding guide channel, and wherein said guide channels each include a laterally outer guide track for said door and a laterally inner guide track for a hinge blocks, and said rack is located laterally between said door guide track and said hinge block guide track, a pinion is rotatably mounted to the hinge block and is meshed with the rack.

2. A cabinet as set forth in claim 1, comprising a pair of racks at opposite sides of said door, a pair of pinions meshed with respective ones of said racks, and an equalizing shaft connecting said pinions for common rotation, said shaft extending between and being supported by said hinge blocks for rotation about an axis fixed with respect to said hinge blocks.

3. A cabinet as set forth in claim 2, wherein said rack is recessed with respect to said guide track.

4. A cabinet as set forth in claim 2, wherein the axis about which said door swings from said closed position to said position aligned with said guide channels is upwardly and horizontally offset from the axis of said equalizing shaft in the direction of the opening in the housing.

5. A cabinet as set forth in claim 1, wherein said pinion maintain uniform movement of said door in said guide channels.

6. A cabinet as set forth in claim 5, wherein said guide channels have top and bottom track surfaces forming said door and hinge block guide tracks therebetween.

7. A cabinet as set forth in claim 5, wherein said guide channels are generally C-shape and have top and bottom flanges extending inwardly from a vertical connecting web.

8. A cabinet as set forth in claim 1, wherein said door has a top edge portion turning rearwardly to define a recess, and said hinge blocks include forward projections extending into said recess for pivotal connection to door hinges contained in said recess.

9. A cabinet as set forth in claim 1, wherein said housing has side walls at opposite sides of said opening, and said door guide channels have integral tabs extending laterally outwardly therefrom for snap-fit insertion into openings provided in said side walls.

10. A cabinet as set forth in claim 1, including a component disposed within said housing between side walls of said housing, and means for mounting said component within said housing for horizontal movement between retracted and extended positions, said means for mounting including a pair of longitudinally telescoping slides one at each side of said component and each including inner and outer telescoping rail members, means for attaching said outer rail members of said slides to said side walls, and a row of hooks at each side of said component for engaging a respective one of said inner rail members for suspending said component.

11. A cabinet as set forth in claim 1, including a drawer mounted in said housing for movement between retracted and extended positions, said drawer including a bottom panel having a row of slots adjacent opposite side edges, a pair of side panels each having an inwardly extending bottom shelf for supporting a side edge portion of said bottom panel and a row of tabs projecting inwardly from said shelf for interconnecting with said row of slots, and a back wall extending upwardly from a rear edge of said bottom panel and having locking tabs spaced from said bottom panel, and said side panels having slots proximate rear edges thereof in which said locking tabs are engaged to hold said side panels upright.

12. A cabinet comprising a housing, a door for closing an opening in said housing, a pair of door guide channels mounted in said housing at opposite sides of said door, a pair of hinge blocks guided by said guide channels for movement between extended and retracted positions, and rack and pinion means for maintaining uniform movement of said door in said guide channels, said door being pivotally attached to said hinge blocks for swinging from a closed position covering said opening when said guide blocks are in said extended position to a position aligned with said guide channels for insertion into said guide channels and movement with said guide blocks to an open position inside said housing, said rack and pinion means including a rack contained in each one of said guide channels, wherein said guide channels each include a laterally outer guide track for said door and a laterally inner guide track for said hinge blocks, and said rack is located laterally between said door guide track and said hinge block guide track, wherein said guide channels are generally C-shape and have top and bottom flanges extending inwardly from a vertical connecting web, wherein said bottom flange has a stepped upper surface including a laterally outer portion closest to said vertical connecting web cooperating with said top flange to form said door track, a laterally intermediate portion carrying said rack lower than said laterally outer portion, and a laterally inner portion, lower than said laterally outer portion, cooperating with said top flange to form said hinge block track.

13. A cabinet comprising a housing, a door for closing an opening in said housing, a pair of door guide channels mounted in said housing at opposite sides of said door, and a pair of hinge blocks guided by said guide channels for movement between extended and retracted positions, said door being pivotally attached to said hinge blocks for swinging from a closed position covering said opening when said guide blocks are in said extended position to a position aligned with said guide channels for insertion into said guide channels and movement with said guide blocks to an open position inside said housing, wherein said door has a top edge portion turning rearwardly to define a recess, and said hinge blocks include forward projections extending into said recess for pivotal connection to door hinges contained in said recess, wherein said forward projections generally have an upwardly turned distal end portion terminating at a hinge pin knuckle and defining a recess for accommodating the rearwardly turned top edge portion when the door is swung upwardly to a horizontal position aligned with said guide channels.

14. A cabinet comprising a housing, a door for closing an opening in said housing, a pair of door guide channels mounted in said housing at opposite sides of said door, and a pair of hinge blocks guided by said guide channels for movement between extended and retracted positions, said door being pivotally attached to said hinge blocks for swinging from a closed position covering said opening when said guide blocks are in said extended position to a position aligned with said guide channels for insertion into said guide channels and movement with said guide blocks to an open position inside said housing, said cabinet including a file drawer mounted in said housing for movement between retracted and extended positions, said drawer including bottom, back and side walls, and a divider adjustably positionable between said side walls, said divider having a front stabilizing foot at a front edge thereof with a front edge lip, and said bottom wall including groove means extending along the front of said bottom wall for capturing the front lip of said foot, and resilient means positioned in an engaging relationship with said back wall for maintaining said front lip engaged in said groove means.

15. A cabinet comprising a housing, a door for closing an opening in said housing, a pair of door guide channels mounted in said housing at opposite sides of said door, hinge block means guided for horizontal movement between extended and retracted positions within said housing, and second hinge means for pivotally attaching said door to said hinge block means for swinging from a closed position covering said opening when said hinge block means is in said extended position to a position aligned with said guide channels for insertion into said guide channels and movement with said hinge means to an open position inside said housing, said door having a top edge portion turning rearwardly to define a recess in which said second hinge means is contained, and said hinge block means including a forward projection extending into said recess for pivotal connection to said second hinge means, wherein a bottom surface of the hinge block means rests at least partially on the corresponding guide channels and wherein said guide channels each include a laterally outer guide track for said door and a laterally inner guide track for said hinge block means and a rack is located laterally between said outer guide track and said inner guide track, and a pinion is rotatably mounted to the hinge block means and is meshed with the rack.

16. A cabinet as set forth in claim 15, wherein said rack and pinion maintain uniform movement of said door in said guide channels.

17. A cabinet comprising a housing, a door for closing an opening in said housing, a pair of door guide channels mounted in said housing at opposite sides of said door, first hinge means guided for horizontal movement between extended and retracted positions within said housing, and second hinge means for pivotally attaching said door to said first hinge means for swinging from a closed position covering said opening when said first hinge means is in said extended position to a position aligned with said guide channels for insertion into said guide channels and movement with said hinge means to an open position inside said housing, said door having a top edge portion turning rearwardly to define a recess in which said second hinge means is contained, and said first hinge means including a forward projection extending into said recess for pivotal connection to said second hinge means, wherein said forward projections generally have an upwardly turned distal end portion terminating at a hinge pin knuckle and defining a recess for accommodating the rearwardly turned top edge portion when the door is swung upwardly to a horizontal position aligned with said guide channels.

18. A cabinet comprising a housing having side walls, a component disposed within said housing between said side walls, and means for mounting said component within said housing for horizontal movement between retracted and extended positions, said means for mounting including a pair of longitudinally telescoping slides one at each side of said component and each including inner and outer telescoping rail members, means for attaching said outer rail members of said slides to said side walls, and hook means at each side of said component for engaging a respective one of said inner rail members for suspending said component, said hook means including a row of hooks, and said inner rail member including a row of hook receiving elements spaced along its length in which corresponding hooks engage.

19. A cabinet comprising a housing having side walls, a component disposed within said housing between said side walls, and means for mounting said component within said housing for horizontal movement between retracted and extended positions, said means for mounting including a pair of longitudinally telescoping slides one at each side of said component and each including inner and outer telescoping rail members, means for attaching said outer rail members of said slides to said side walls, and hook means at each side of said component for engaging a respective one of said inner rail members for suspending said component, wherein said hook means includes a row of hooks, and said inner rail member includes a row of hook receiving elements spaced along its length in which corresponding hooks engage, wherein said hooks and hook receiving elements are correspondingly sized and progressively increase in length going from front to back.

20. A cabinet as set forth in claim 19, wherein said component has at each side thereof guide track means for receiving and riding on said hook receiving elements.

21. A cabinet as set forth in claim 20, wherein said component is mounted within said housing by horizontal insertion between said slides.

22. A cabinet comprising a housing having side walls, a component disposed within said housing between said side walls, and means for mounting said component within said housing for horizontal movement between retracted and extended positions, said means for mounting including a pair of longitudinally telescoping slides one at each side of said component and each including inner and outer telescoping rail members, means for attaching said outer rail members of said slides to said side walls, and hook means at each side of said component for engaging a respective one of said inner rail members for suspending said component, said hook means including a row of hooks, said inner rail member including a row of hook receiving elements spaced along its length in which corresponding hooks engage, and said component including means for preventing disengagement of at least one of said hooks from a corresponding one of said hook receiving elements.

23. A cabinet comprising a housing having side walls, a component disposed within said housing between said side walls, and means for mounting said component within said housing for horizontal movement retracted and extended positions, said means for mounting including a pair of longitudinally telescoping slides one at each side of said component and each including inner and outer telescoping rail members, means for attaching said outer rail members of said slides to said side walls, and hook means at each side of said component for engaging a respective one of said inner rail members for suspending said component, wherein said hook means includes a row of hooks, and said inner rail members include a row of hook receiving elements spaced along its length in which corresponding hooks engage, said component including means for preventing disengagement of at least one of said hooks from a corresponding one of said hook receiving elements, wherein said means for preventing includes releasable latch means having a first position preventing disengagement and a second position permitting disengagement to enable removal of said component.

24. A cabinet as set forth in claim 23, wherein said latch means is formed integrally with a side wall of said component.

25. A cabinet comprising a housing having side walls, a component disposed within said housing between said side walls, and means for mounting said component within said housing for horizontal movement between retracted and extended positions, said means for mounting including a pair of longitudinally telescoping slides one at each side of said component and each including inner and outer telescoping rails, clip means on said outer rails securable in openings in said side walls for mounting said telescoping slides to said side walls, and said component having formed in each side thereof guide track means for guiding insertion of said component between said inner rails when said outer rails are mounted to said side walls, and means for preventing longitudinal movement of said inner rails relative to said component upon full insertion of said component between said inner rails, said means for preventing including hook means at each side of said component for engaging a respective one of said inner rails for suspending said component, said hook means including a row of hooks.

* * * * *